US006374101B1

(12) United States Patent
Gelbien

(10) Patent No.: US 6,374,101 B1
(45) Date of Patent: Apr. 16, 2002

(54) PAGER-BASED CONTROLLER

(75) Inventor: Lawrence J. Gelbien, West Islip, NY (US)

(73) Assignee: Keyspan Technologies, Inc., Hicksville, NY (US)

( * ) Notice: Subject to any disclaimer, the term of this patent is extended or adjusted under 35 U.S.C. 154(b) by 0 days.

(21) Appl. No.: 09/010,278

(22) Filed: Jan. 21, 1998

Related U.S. Application Data

(60) Provisional application No. 60/036,275, filed on Jan. 24, 1997.

(51) Int. Cl.[7] ..... G08B 5/22

(52) U.S. Cl. ..... 455/420; 455/3.03; 455/352; 340/7.1; 340/7.38; 340/825.66

(58) Field of Search ..... 455/38.2, 38.1, 455/309, 312, 3.03, 352, 353, 420; 340/825.66, 825.44, 311.1, 605, 7.1, 7.38, 825.61, 310.01

(56) References Cited

U.S. PATENT DOCUMENTS

| | | | | |
|---|---|---|---|---|
| 3,114,243 A | | 12/1963 | Winters | |
| 3,372,899 A | | 3/1968 | McPherson | |
| 3,614,326 A | | 10/1971 | Cameron | |
| 3,653,595 A | | 4/1972 | Greengard, Jr. et al. | |
| 3,726,477 A | | 4/1973 | Shapiro | |
| 3,783,193 A | | 1/1974 | Lee | |
| 3,859,462 A | * | 1/1975 | Saxon | 340/825.44 |
| 4,146,049 A | | 3/1979 | Kruse et al. | |
| 4,185,650 A | | 1/1980 | Neves et al. | |
| 4,206,444 A | | 6/1980 | Ferlan | |
| 4,208,630 A | | 6/1980 | Martinez | |
| 4,209,131 A | | 6/1980 | Barash et al. | |
| 4,266,097 A | | 5/1981 | Cannon et al. | |
| 4,273,961 A | | 6/1981 | Blank et al. | |
| 4,322,842 A | * | 3/1982 | Martinez | 455/353 |
| 4,396,149 A | | 8/1983 | Hirsch | |
| 4,473,821 A | | 9/1984 | Yang et al. | |
| 4,598,286 A | | 7/1986 | Miller et al. | |
| 4,626,984 A | | 12/1986 | Unruh et al. | |

(List continued on next page.)

FOREIGN PATENT DOCUMENTS

EP 0716553 6/1996

OTHER PUBLICATIONS

Page Tap Model #PT8–OC Catalogue, Apr. 9, 1996.
Page Tap TT4 Remote Control Switch Catalogue, Apr. 9, 1996.
Page Tap ISD Catalogue.

*Primary Examiner*—William Trost
*Assistant Examiner*—Simon Nguyen
(74) *Attorney, Agent, or Firm*—Dilworth & Barrese, LLP

(57) ABSTRACT

A pager-based controller including at least one pager configured to receive a signal from a remote location, the at least one pager being further configured to provide an output to change an on-off state of an external electrical component; a heater unit and a fan unit to maintain a predetermined temperatune range within the pager-based controller; a power supply for supplying a required AC voltage and DC voltage to electrical components within the pager-based controller; a latching relay electrically connected to the at least one pager; an interface unit electrically connected to the at least one pager and the latching relay, the interface unit configured to receive the output from the at least one pager and supply a corresponding signal to the latching relay; the latching relay including at least one normally-open contact and at least one normally-closed contact, for providing one of an open and a closed circuit to the external electrical component in response to an energization state of a coil within the latching relay; and a timing relay having a contact electrically connected in series with the output of the at least one pager to eliminate spurious signals from the at least one pager during a power-up operation.

19 Claims, 6 Drawing Sheets

U.S. PATENT DOCUMENTS 4,628,306 A 12/1986 Root
4,691,341 A 9/1987 Knoble et al.
4,724,334 A * 2/1988 Melek ..... 307/113
4,806,906 A 2/1989 Oda et al.
4,893,351 A 1/1990 McKee et al.
4,935,736 A 6/1990 Meierdierck
4,962,522 A * 10/1990 Marian ..... 340/825.44
4,996,703 A 2/1991 Gray
5,012,233 A 4/1991 Poulsen, Jr.
5,043,721 A 8/1991 May
5,061,921 A 10/1991 Lesko et al.
5,070,329 A 12/1991 Jasinaki
5,148,158 A * 9/1992 Shah ..... 340/825.17
5,153,582 A 10/1992 Davis
5,175,758 A 12/1992 Levanto et al.
5,208,855 A 5/1993 Marian
5,281,962 A 1/1994 Vanden Heuvel et al.
5,291,193 A 3/1994 Isobe et al.
5,337,044 A * 8/1994 Folger et al. ..... 370/825.44
5,359,318 A 10/1994 Asai et al.
5,392,452 A 2/1995 Davis
5,394,560 A 2/1995 Kane
5,455,572 A 10/1995 Cannon et al.
5,469,133 A 11/1995 Hensler et al.
5,608,655 A 3/1997 Moughanni et al.
5,661,468 A * 8/1997 Marcoux ..... 340/825.44
5,693,952 A * 12/1997 Cox ..... 250/551
5,790,036 A * 8/1998 Fisher et al. ..... 340/605
5,872,505 A * 2/1999 Wicks et al. ..... 340/311.1
5,881,364 A * 3/1999 Higuchi ..... 455/38.2
5,986,574 A 11/1999 Colton ..... 340/870.02

* cited by examiner

PAGER-BASED CONTROLLER

CROSS REFERENCE TO RELATED APPLICATION

This application claims the benefit of U.S. Provisional Application No. 60/036,275, filed Jan. 24, 1997, and incorporated by reference herein.

BACKGROUND OF THE INVENTION

1. Field of the Invention

The present disclosure relates generally to remote control systems for remotely controlling electrical equipment. More particularly, this disclosure relates to a controller which receives pager signals from a pager network to control electrical/electronic equipment.

2. Description of the Related Art

Remote control systems which are capable of generating and transmitting control signals to remotely control electronic equipment are known in the prior art. Electric utility companies, for example, typically utilize a private remote control system with a private radio network to remotely control on/off switching of capacitor banks in accordance with daily electric power requirements. Such systems, however, are costly in that they require implementation and maintenance of the private radio network. In addition, their utility is generally limited to a narrow geographical region.

Hence, a need exists for a generally inexpensive remote control system which uses the public system telephone network (PSTN) to transmit control signals over a wide geographical region to remotely control electrical/electronic equipment.

SUMMARY OF THE INVENTION

The present invention relates to a remote control system in which RF pager signals transmitted by means of a wide area pager network, are received by a pager-based controller to control electrical or electronic equipment. A human operator or automated computer at a telecommunication station connected to the PSTN, initiates the transmission of RF pager signals via the pager network to the pager-based controller at the remote equipment site. In a preferred embodiment, the pager-based controller includes at least one conventional pocket pager which has been modified by having its vibrator or other indicator removed. Each time the pocket pager receives a page, it outputs a control voltage normally used to drive the vibrator. This control voltage is used to change the switching state of a relay within the controller to thereby control the on-off state of external electronics connected to the relay.

In an exemplary embodiment, two pagers are employed within the controller, each having a different pager (telecommunication) number. One pager is paged to set the relay to an ON state, while the other is paged to set the relay to an OFF state. The relay may be connected to the external electronics. As such, the external electronics can be switched into and out of operation merely by the remote operator or automated computer dialing the telecommunication number of the respective pager as allocated by the PSTN and pager network.

A pager-based controller is provided which includes at least one pager configured to receive a signal from a remote location, the at least one pager being further configured to provide an output to change an on-off state of an external electrical component; a heater unit and a fan unit to maintain a predetermined temperature range within the pager-based controller; a power supply for supplying a required AC voltage and DC voltage to electrical components within the pager-based controller; a latching relay electrically connected to the at least one pager; an interface unit electrically connected to the at least one pager and the latching relay, the interface unit configured to receive the output from the at least one pager and supply a corresponding signal to the latching relay; the latching relay including at least one normally-open contact and at least one normally-closed contact, for providing one of an open and a closed circuit to the external electrical component in response to an energization state of a coil within the latching relay; and a timing relay having a contact electrically connected in series with the output of the at least one pager to eliminate spurious signals from the at least one pager during a power-up operation.

A method of remotely controlling an electronic device is also provided which includes the steps of transmitting a first pager signal from a pager network to a pager-based controller having at least one pager therein; outputting a first control voltage from the at least one pager controller to change a switching state of a relay within the pager-based controller to thereby control an on-off state of an external electronic device which is electrically connected to the relay; and transmitting a second pager signal from the pager network to the pager-based controller at the remote site to cause a second control voltage to change the switching state of the relay within the controller to switch the on-off state of the external electronic device to a state which is opposite that which was caused by the first control voltage.

Advantageously, the use of conventional pocket pagers within the controller requires minimal set-up and maintenance costs and provides a reliable method of controlling the capacitor bank via the use of the pager network. Set-up costs are minimal since a customized private radio network for the transmission of control signals is not necessary.

BRIEF DESCRIPTION OF THE DRAWINGS

For a better understanding of the invention, reference is made to the following description of exemplary embodiments thereof, and to the accompanying drawings, wherein.

DETAILED DESCRIPTION OF THE PREFERRED EMBODIMENTS

Figure 1:
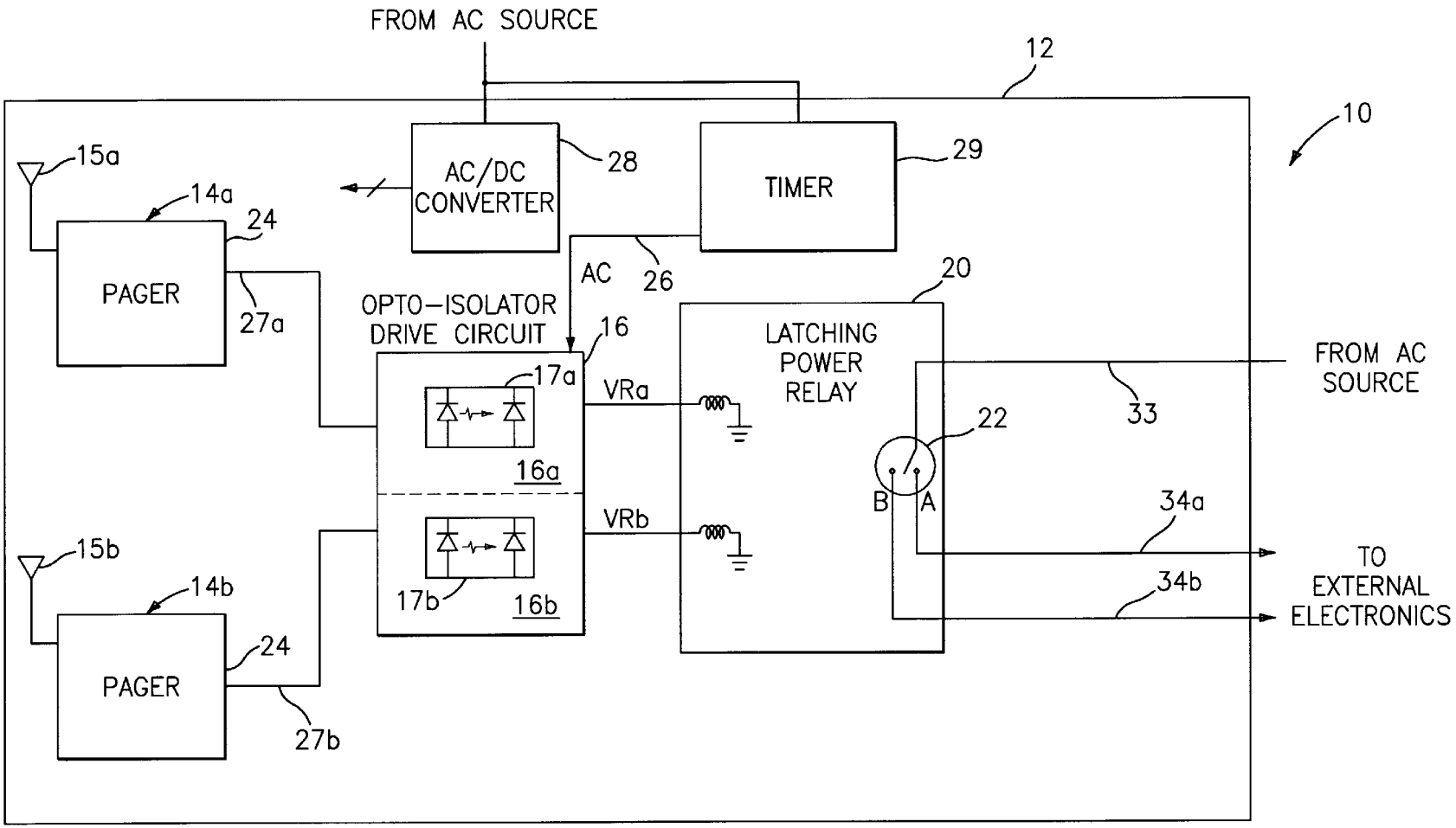
FIG. 1 is a block diagram of a pager-based controller in accordance with the present invention.

FIG. 1 shows a simplified block diagram of the internal components of a pager-based controller 10 in accordance with the present invention. Controller 10 includes a pair of pocket pagers 14*a*, 14*b* which receive paging signals from a pager network. Pagers 14*a*, 14*b* are registered with the pager network and are each allocated a different pager (telephone) number. Each time a remote operator or automated computer dials the respective pager number through the PSTN, the associated pager 14*a* or 14*b* receives the page signal via the PSTN and pager network. Whenever the page signal is received, the associated pager 14*a* or 14*b* outputs a control signal to an opto-isolator drive circuit 16, which in turn changes a switching state of a power relay 20. When pager 14*a* receives a page signal, relay 20 is switched to an ON state. When pager 14*b* receives a page signal, relay 20 is switched to an OFF state.

In a preferred embodiment, the switching of power relay 20 is used to switch an external electrical device on or off. The external electrical device may be, for example, a remote computer system, building lighting, a security system, a capacitor bank, a remote electric generating station, an electric meter or a thermostat. However, it is to be understood that pager-based controller 10 may alternatively be employed to control other types of electrical or electronic equipment. In addition, while it is preferable to employ a pair of pagers 14*a*, 14*b*, a single pager could be alternatively utilized within each controller 10. The use of two pagers ensures that the controller remains in operational sync. With the single pager approach, alternating pages would change the switching state of the relay. As such, it would then be necessary for the remote operator or computer to keep track of the current switching state of the relay.

Controller 10 is preferably embodied as a small portable unit deployable in the field, with a fiberglass housing 12 to environmentally protect the circuitry therein. Pocket pagers 14*a*, 14*b* may be modified conventional pagers (e.g., Motorola Bravo, Bravo Plus or Advisor pagers) and can be maintained within their original housings 24 to simplify mounting within the controller 10. Also, electromagnetic shielding may be used along the inner surface of the pager housing 24 to reduce electromagnetic interference (EMI) susceptibility. The pocket pagers typically operate in a one-way pager system, although two-way pagers can also be used. Pagers 14*a* and 14*b* are modified from their commercial design simply by having their batteries and vibrators removed. Conventional pagers include a vibrator which vibrates whenever a page is received to convey vibrational movement to the person wearing the pager. Vibrating action is typically selected by the user via a mode switch on the pager. When vibrating action is selected, the audio output of the pager is deactivated such that the user can effectively receive pages without an accompanying (disturbing) audible tone.

AC line voltage (e.g., 115V, 60 Hz) is supplied to controller 10 and applied to an AC/DC converter 28, which converts the line voltage to a low DC voltage. This DC voltage is used to power the electronics within controller 10, including pagers 14*a* and 14*b* (which have their batteries removed). As an alternative, an alternative energy source known to one having ordinary skill in the art, such as a DC battery or solar power, could be used to power the various components rather than the AC line voltage and converter 28.

When a page signal is transmitted to controller 10, pager 14*a* or 14*b* receives the page and responds by outputting the control voltage normally used to drive the respective vibrator. The control voltage is supplied to an opto-isolator drive circuit 16 on line 27*a* or 27*b*. Drive circuit 16 includes two portions, 16*a* and 16*b*, each including respective opto-isolator electronics 17*a* or 17*b*. Drive circuit 16 responds to the control voltage on line 27*a* or 27*b* by outputting a respective output voltage VRa or VRb at an appropriate level to power relay 20, preferably a latching relay. When one of these voltages is applied to relay 20, the switching state of the relay changes.

The power relay 20 includes a latching relay switch 22 that locks in one of two positions A or B corresponding to an energized or de-energized state of the external electronic device, until electrically reset by a new application of the voltage VRa or VRb from drive circuit 16. The switch 22 input is connected to the AC line voltage on line 33. The switch output connects to either line 34*a* or 34*b* which may connect to a high voltage (several thousand volts) switch at the terminals of the external electrical device. As such, when power relay 20 changes switching state, the operational state of the external electrical device is correspondingly changed via the high voltage switch.

The opto-isolators within drive circuit 16 operate to isolate the pagers 14 from the relatively high voltage/current levels at the power relay 20. The drive circuit 16 thus prevents voltage spikes from reaching the pagers 14 during operation of the external electrical device. A fuse may also be provided on lines 33 and/or 34*a*, 34*b* to avoid damage to the relay 20 if current is excessively high.

AC/DC converter 28 supplies DC voltage to pagers 14*a*, 14*b* and drive circuit 16. Typically, the energy requirement of each pager is 80 mA at 1.5 VDC. AC voltage is provided to the drive circuit 16 on the line 26 through a power-up, time delay relay (timer) 29. Timer 29 monitors the AC line voltage and functions to prevent the relay 20 from changing its switching state in the event of a loss or momentary drop of AC voltage as in a power failure. This is accomplished by temporarily removing AC control power to the output of the opto-isolator drive circuit. Additionally, each time a pager is turned on or powered up, a test beep or vibration is activated. This feature may not be capable of being programmed out of the pagers. Timer 29 therefore prohibits the power relay 20 from operating in response to a test beep or vibration. The timer 29 would be unnecessary for embodiments that do not operate with AC line voltage but which instead employ a DC power source.

Each controller 10 preferably includes a heater and fan (not shown) within the enclosure to maintain the pagers and other electronics within a proper operating temperature range.

Figure 2:
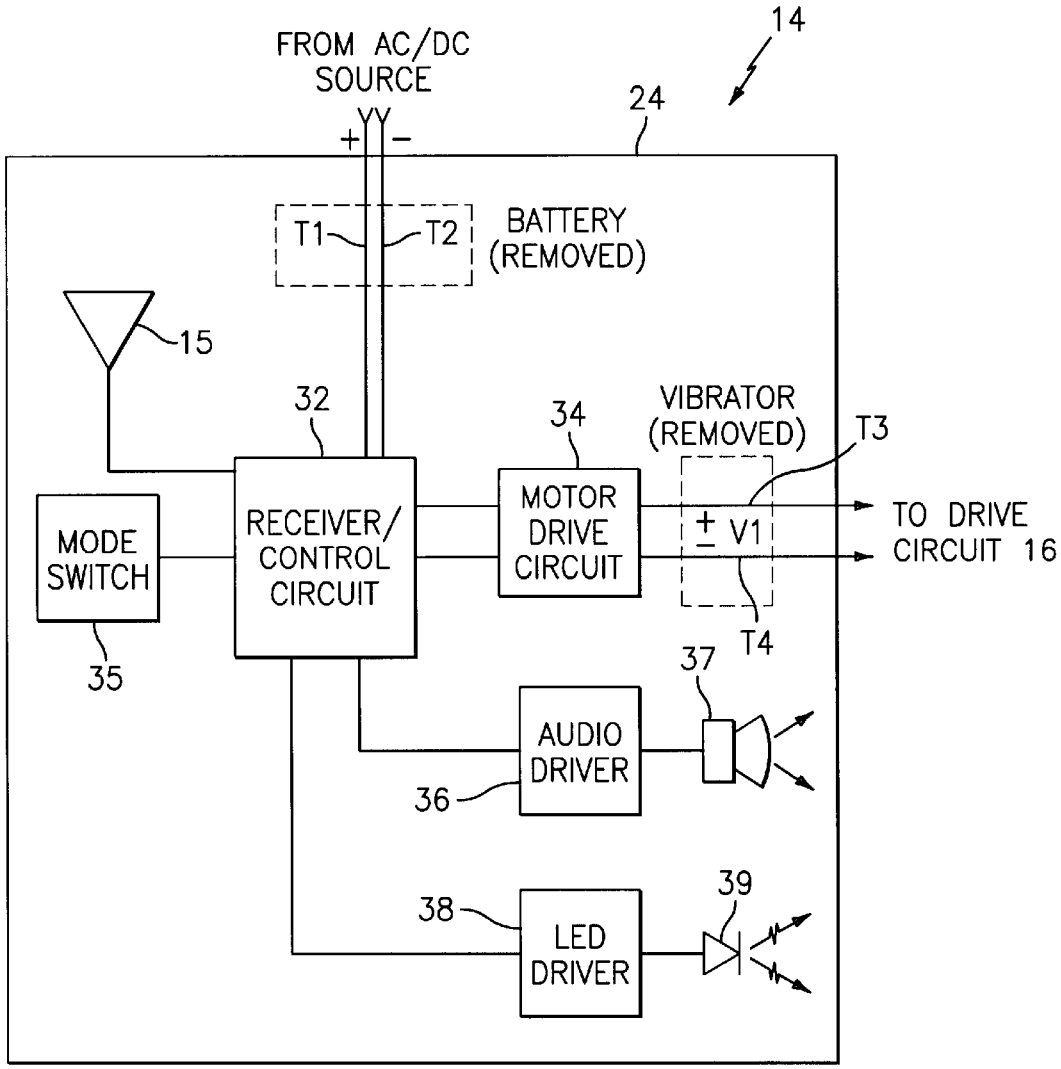
FIG. 2 is a block diagram of a conventional pocket pager configured to be utilized within the pager-based capacitor bank controller of the present invention.

With reference now to FIG. 2, a simplified block diagram of the conventional pocket pager 14 modified for use as pager 14*a* or 14*b* within the pager-based controller 10 is illustrated. Pocket pager 14 has the battery and vibrator removed and the battery contact points T1, T2 coupled to the AC/DC converter 28 to receive the proper operating voltage for the electronics within the pager. A motor drive circuit 34 is coupled to the opto-isolator drive circuit 16 via connection at terminal points T3, T4 normally connected to the vibrator. A mode switch 35 is set to the vibrator position such that when a page is received by receiver/control circuit 32 via antenna 15, it responds by sending a command to motor drive circuit 34 rather than to the audio driver 36. Motor drive circuit 34 responds by outputting a voltage V1 of approximately 1.5 volts for a short duration. Pager 14 also includes LED driver 38, LED display 39 and audio transducer 37. These components are preferably not removed, since they can be used to verify reception of pages for testing purposes. It is noted that in alternative embodiments of the controller 10, it is possible to tap into the LED driver 38 and/or audio driver 36 (rather than or in addition to the motor drive circuit 34) to derive control signals for controlling the power relay switching state.

Furthermore, conventional pocket pagers are normally programmed by the pager company prior to delivery. A standard program used by the pager company requires the pager to give a reminder beep or vibration if the page is not acknowledged by pressing a button. The vibration is caused by a small motor with an unbalanced shaft which vibrates the pager. Since the pagers will be unattended, the typical pager programming needs to be modified to disable the reminder function.

Figure 3:
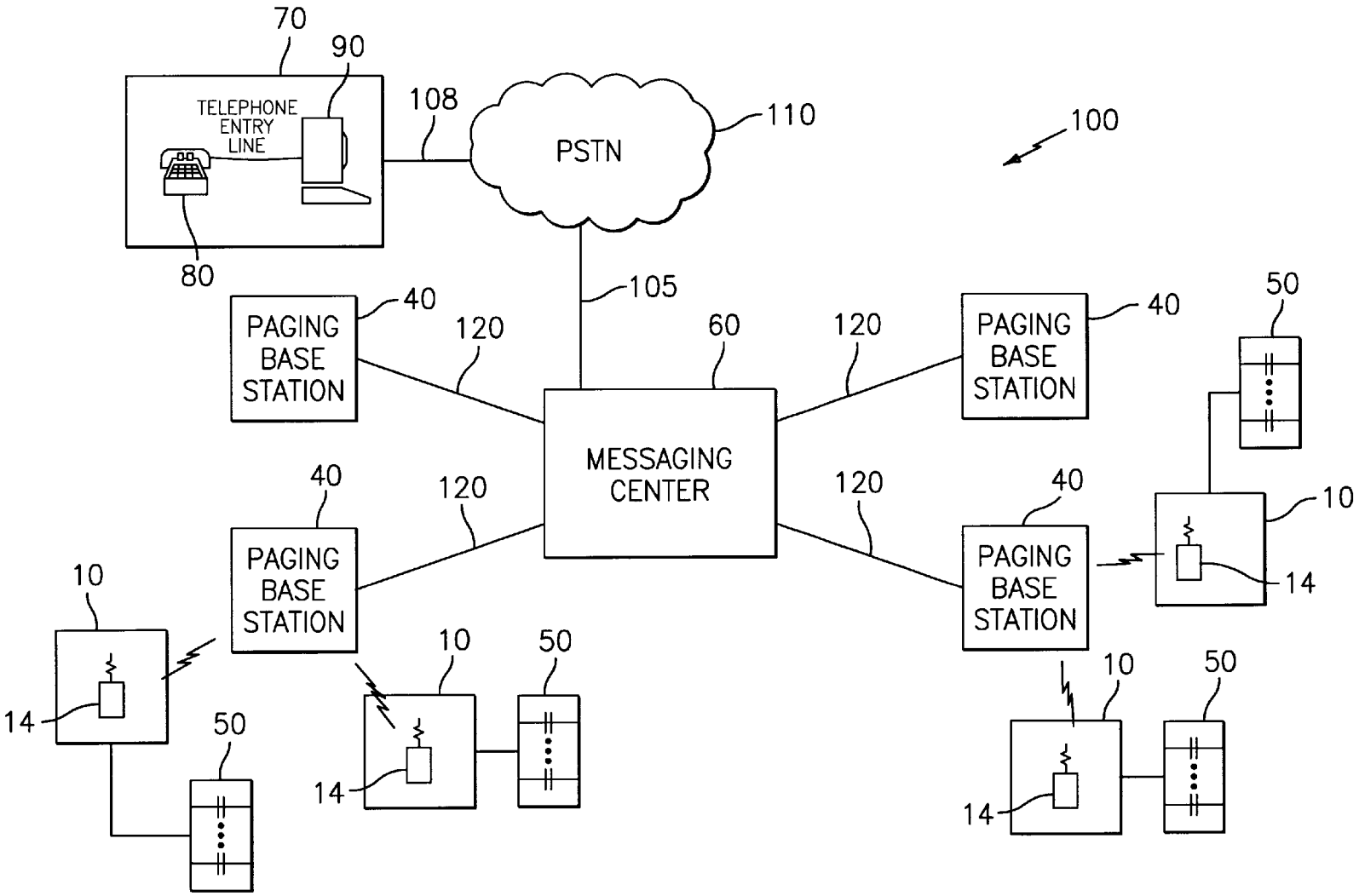
FIG. 3 is a block diagram of an illustrative remote control system including a pager network and multiple pager-based controllers of the present invention.

Referring now to FIG. 3, a remote control system 100 is illustrated which includes the pager-based controller 10 of the present invention. The system 100 controls the operational states of external electrical devices 50. System 100 includes a remote telecommunication terminal 70 which is connected to the PSTN 110 by a conventional telephone line 108. Terminal 70 can be as simple as a single telephone 80 operated by a human operator, or as complex as a fully automated computer 90 which maintains, inter alia, a memory of the operational state of each external electrical device. In the latter case, computer 90 automatically dials the pager numbers of pagers 14 within associated controllers 10 to dynamically switch specific external electrical devices 50 into and out of operation based on the desired result. For example, an electric generating station or capacitor bank may be switched in and out of service based on electric power requirements within a certain geographical area. When a page is initiated at terminal 70, the call is relayed through the PSTN 110 to a paging messaging center 60 via a wireline or wireless communication link 105. Messaging center 60 is coupled to each of a number of paging base stations 40 by means of wireline or wireless communication links 120. Typically, with one-way pager networks, each pager registered in the system can receive pages only within specific geographical regions associated with a particular one or more pager base stations 40. As such, when a call to a specific pager number is routed by the PSTN to messaging center 60, the messaging center relays the call to the particular base station 40 associated with that pager. Each associated base station 40 then transmits the page signal. In the exemplary system described herein, since the external electrical devices controlled by each controller 10 are typically at fixed locations, only a single base station 40 need transmit the specific page signal to change the switching state of the corresponding external electrical device 50. The pager within controller 10 receives the specific page signal and switches the relay state accordingly. (It is noted that in some pager networks, each pager base station may transmit all pages to every pager registered with the system. The exemplary system of this invention can operate with this type of pager network as well).

A security measure may be incorporated to prevent persons other than the responsible operator or computer system at terminal 70 from dialing the pager numbers and thus changing the states of capacitor banks. For example, a security/access code can be allocated by the pager network service provider to each pager 14. Therefore, in order to communicate with a pager 14 in the pager system 100, the security/access code must be transmitted followed by the corresponding telephone number (or vice versa) for that particular pager 14.

Figure 4:
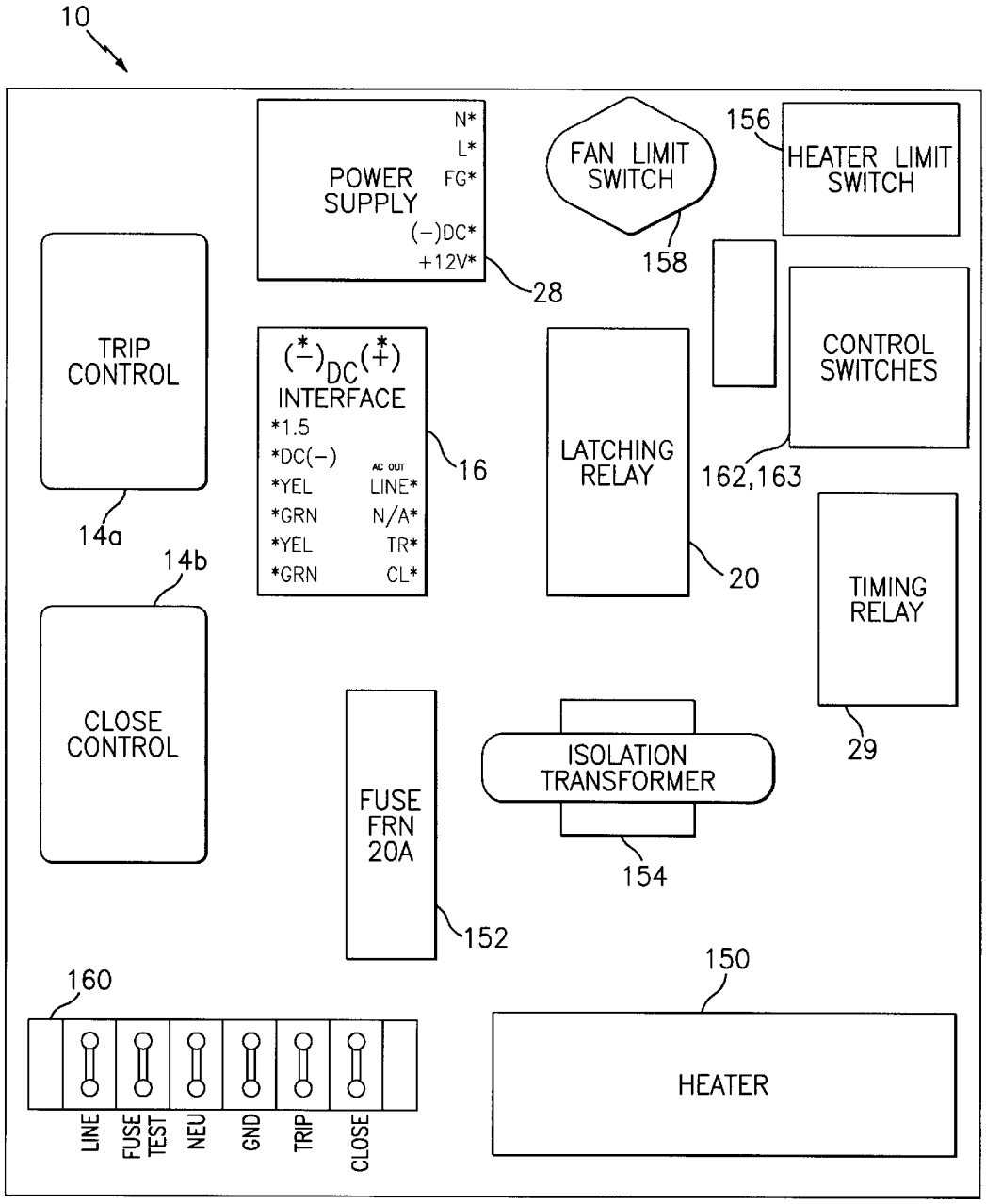
FIG. 4 is a block diagram of a typical layout of components within the pager-based controller.
Figure 5:
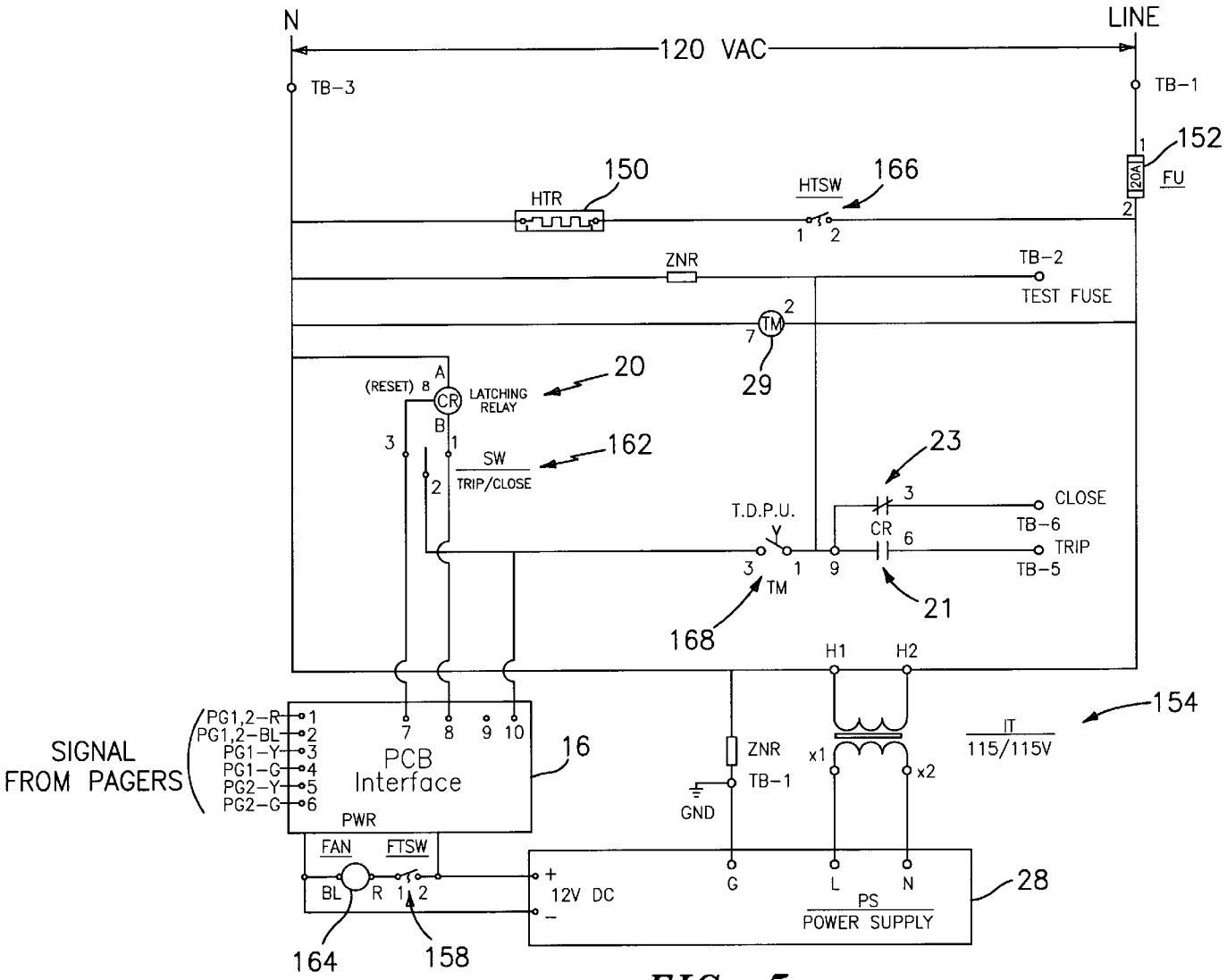
FIG. 5 is a schematic illustrating the electrical connections and layout of the components within the pager-based controller.

Referring now to FIGS. 4 and 5, typical physical and electrical layouts of the several individual components of pager-based controller 10 are illustrated. The boxes labeled "TRIP CONTROL" and "CLOSE CONTROL" represent pagers 14*a* and 14*b* for receiving pager signals from a pager network. The "POWER SUPPLY" 28 supplies 115 VAC power to components such as heater 150, latching relay 20 and timing relay 29. The 115 VAC power is connected to the above components through isolation transformer 154. Heater 150 operates in response to the heater control switch 166 which is preferably set to close at 45° F. and open at 55° F. Power supply 28 also supplies 12 VDC power to the fan 164 and the interface 16. Interface 16 provides a 1.5 VDC supply to each of pagers 14*a* and 14*b* and includes connections to receive the signals from the pagers which interface with latching relay 20. The 12 VDC fan 164 operates in response to the thermostat fan control switch 158 which is preferably set to open at 90° F. and close at 110° F.

During operation, in response to a signal from pager 14*a* and 14*b*, the coil in latching relay 20 will be selectively energized to provide a corresponding output to an external electrical device. In the trip position, latching relay 20 will be energized thereby closing the normally open (NO) trip contact 21 and opening the normally closed (NC) close contact 23, as long as the time delay switch 168 off the timing relay 29 is closed, and the external electrical component will trip. When the coil in latching relay 20 is de-energized, the contacts will return to their normal state, thereby closing the circuit of the external electrical component. Timing relay 29 may be set within a range of approximately one minute to approximately ten minutes, and is preferably set for one minute to eliminate spurious changes in the circuit during power start-up. Terminal block 160 is provided within the controller housing to connect the 115 VAC power feed to the controller, and to connect the latching relay contacts to the apparatus to be controlled. Switch 162 is provided to facilitate manual control of the output from the controller. Switch 162 may be selectively switched between a trip and a close position to energize or de-energize latching relay 20.

Figure 6:
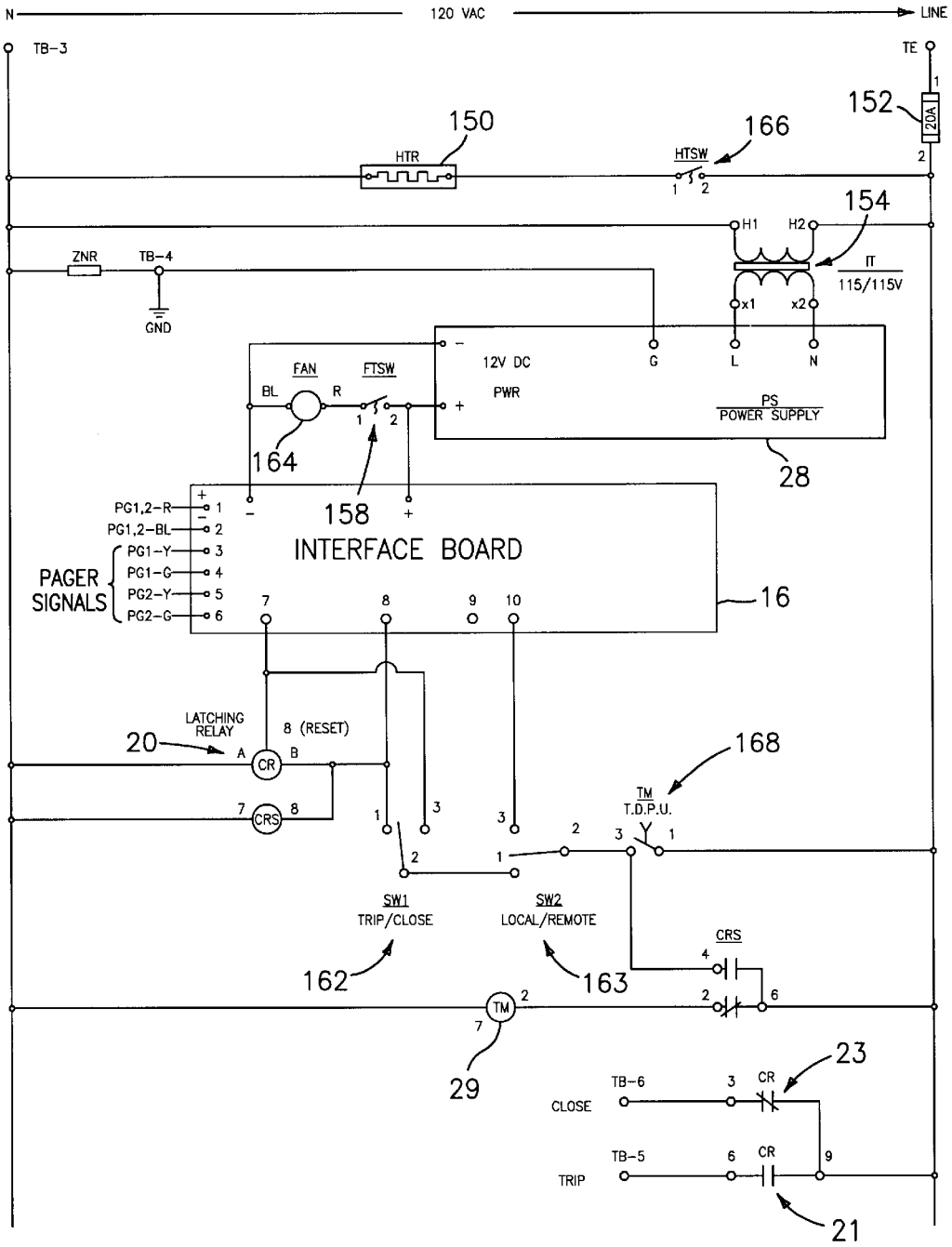
FIG. 6 is a schematic illustrating the electrical connections and layout of the components within a preferred embodiment of the pager-based controller.

In a preferred embodiment, the pager-based controller includes an additional control switch 163. As illustrated in the electrical schematic of FIG. 6, control switch 163 is in series with the associated contacts and switch of timing relay 29. The purpose of switch 163 is to permit a user to switch between a local and remote control, while the user is at the remote location. That is, when switch 163 is in the "local" position, the user may locally operate switch 162 between a trip and close position. During normal operating conditions, switch 163 will be in the "remote" position such that the pager-based controller will receive and output signals corresponding to remote signals sent to the pagers.

Thus disclosed is a pager-based remote control system and controller particularly useful for controlling switching states of electronic equipment. Advantageously, since conventional pocket pagers are used to receive RF paging signals through a paging network, there are minimal costs in setting up and maintaining the remote control system of the present disclosure. Further, customized transceiver circuitry and a radio network are not necessary to operate the pager-based controller 10 of the present disclosure.

It is to be understood that the embodiments described herein are merely exemplary and that one skilled in the art can make many modifications and variations to the disclosed embodiments without departing from the spirit or scope of the invention. For example, the present invention is not to be understood to be limited to employment in a pager system, but rather may be employed into numerous wireless communication systems, such as a Personal Communication Network (PCN) or into communication systems utilizing Personal and/or Terminal Mobility managers. According, all such modifications and variations are intended to be included within the scope and spirit of the present invention.

What is claimed is:

1. A system for controlling the on-off state of a remote electrical device comprising:

a pager-based controller; and a terminal for transmitting a signal to the pager based controller;

wherein the pager-based controller comprises a housing; at least one pager positioned within the housing and configured to receive a signal from the terminal, said at least one pager being further configured to provide an alarm output to change an on-off state of an external electrical device; and a time delay relay having a contact electrically connected in series with the alarm output of the at least one pager, said time delay relay operable to prevent the pager from changing the on-off state of the external electrical device for a predetermined time period during a power-up operation of the pager-based controller.

2. The system for controlling the on-off state of a remote electrical device as recited in claim 1, wherein the pager-based controller further comprises an interface unit electrically connected to the at least one pager, the interface unit configured to receive the output from the at least one pager and supply a corresponding signal the external electrical device.

3. The system for controlling the on-off state of a remote electrical device as recited in claim 1, wherein the terminal is a telephone.

4. The system for controlling the on-off state of a remote electrical device as recited in claim 1, wherein the terminal is a computer.

5. The pager-based controller as recited in claim 1 wherein the electrical device is a capacitor bank.

6. The system for controlling the on-off state of a remote electrical device as recited in claim 1, wherein the at least one pager is removably positioned within the housing.

7. A pager-based controller which comprises:

a housing;

at least one pager positioned within the housing and configured to receive a signal from a remote location, said at least one pager being further configured to provide an alarm output to change an on-off state of an external electrical device; and a time delay relay having a contact electrically connected in series with the alarm output of the at least one pager, said time delay relay operable to prevent the pager from changing the on-off state of the external electrical device for a predetermined time period during a power-up operation pager-based controller.

8. The pager-based controller as recited in claim 7, further comprising an interface unit electrically connected to the at least one pager, the interface unit configured to receive the output from the at least one pager and supply a corresponding signal to the external electrical device.

9. The pager-based controller as recited in claim 8, wherein the interface unit is further configured to electrically isolate the at least one pager from at least one of a high voltage and a high current.

10. The pager-based controller as recited in claim 8, wherein the interface unit is an opto-isolator drive circuit.

11. The pager-based controller as recited in claim 7, further comprising a power supply for supplying a required AC voltage and DC voltage to electrical components within the pager-based controller.

12. The pager-based controller as recited in claim 7, further comprising a latching relay electrically connected between the interface unit and the external electrical device.

13. The pager-based controller as recited in claim 12, wherein the latching relay includes at least one normally-open contact and at least one normally-closed contact for providing one of an open and a closed circuit to the external electrical device in response to an energization state of a coil within the latching relay.

14. The pager-based controller as recited in claim 7, wherein the time delay relay is set for a delay within a range of about one minute to about ten minutes.

15. The pager-based controller as recited in claim 7, further comprising a switch capable of switching between local and remote control of the controller.

16. The pager-based controller as recited in claim 7, wherein the output of the at least one pager is a voltage from a motor drive circuit within the at least one pager.

17. The pager-based controller as recited in claim 7, further comprising a heater unit and a fan unit to maintain a predetermined temperature range within the pager-based controller housing.

18. The pager-based controller as recited in claim 17, wherein the predetermined temperature range is between 45 degrees fahrenheit and 110 degrees fahrenheit.

19. The pager-based controller as recited in claim 7, wherein the at least one pager is removably positioned within the housing.

* * * * *